US006537446B1

(12) United States Patent
Sanguinetti

(10) Patent No.: US 6,537,446 B1
(45) Date of Patent: Mar. 25, 2003

(54) DRAINAGE FILTER SYSTEM FOR DEBRIS AND CONTAMINANT REMOVAL

(75) Inventor: Peter S. Sanguinetti, Roseville, CA (US)

(73) Assignee: The Water Sweeper, Lodi, CA (US)

( * ) Notice: Subject to any disclaimer, the term of this patent is extended or adjusted under 35 U.S.C. 154(b) by 0 days.

(21) Appl. No.: 09/810,301

(22) Filed: Mar. 16, 2001

(51) Int. Cl.[7] ..... E03F 5/06

(52) U.S. Cl. ..... 210/163; 210/266; 210/282; 210/316; 210/474; 210/470; 404/4

(58) Field of Search ..... 210/163, 164, 210/165, 166, 266, 282, 314, 316, 317, 474, 477, 470; 404/4, 5

(56) References Cited

U.S. PATENT DOCUMENTS

| | | | | | |
|---|---|---|---|---|---|
| 232,948 | A | | 10/1880 | Dernham | |
| 506,267 | A | | 10/1893 | Sefton | |
| 672,868 | A | | 4/1901 | Banwell | |
| 783,556 | A | | 2/1905 | Buskirk | |
| 1,041,887 | A | * | 10/1912 | Schodde | 210/164 |
| 1,245,903 | A | | 11/1917 | Gross | |
| 4,419,232 | A | * | 12/1983 | Arntyr et al. | 210/164 |
| 4,594,157 | A | | 6/1986 | McGowan | |
| 5,032,264 | A | * | 7/1991 | Geiger | 210/164 |
| 5,397,464 | A | | 3/1995 | Hannon | |
| 5,405,539 | A | | 4/1995 | Schneider | |
| 5,486,287 | A | * | 1/1996 | Murphy et al. | 210/164 |
| 5,562,819 | A | | 10/1996 | Turner, Jr. et al. | |
| 5,632,888 | A | | 5/1997 | Chinn et al. | |
| 5,702,595 | A | | 12/1997 | Mossburg, Jr. | |
| 5,788,849 | A | | 8/1998 | Hutter, Jr. et al. | |
| 5,820,762 | A | | 10/1998 | Bamer et al. | |
| 5,849,198 | A | | 12/1998 | Sharpless | |
| 5,890,839 | A | | 4/1999 | Gunter | |
| 5,925,241 | A | * | 7/1999 | Aldridge et al. | 210/163 |
| 5,985,157 | A | * | 11/1999 | Leckner et al. | 210/163 |
| 6,015,489 | A | | 1/2000 | Allen et al. | |
| 6,017,166 | A | | 1/2000 | Mossburg, Jr. | |
| 6,080,307 | A | | 6/2000 | Morris et al. | |
| 6,086,758 | A | * | 7/2000 | Schilling et al. | 210/164 |
| 6,106,707 | A | | 8/2000 | Morris et al. | |
| 6,178,565 | B1 | * | 1/2001 | Franco | 210/163 |
| 6,200,484 | B1 | * | 3/2001 | McInnis | 210/164 |
| 6,217,757 | B1 | * | 4/2001 | Fleischmann | 210/163 |
| 6,270,662 | B1 | * | 7/2001 | Gibson et al. | 210/163 |
| 6,270,663 | B1 | * | 8/2001 | Happel | 210/163 |
| 6,287,459 | B1 | * | 9/2001 | Williamson | 210/164 |
| 6,346,191 | B1 | * | 2/2002 | Morris | 210/164 |

* cited by examiner

*Primary Examiner*—Christopher Upton
(74) *Attorney, Agent, or Firm*—Stout, Uxa, Buyan & Mullins, LLP; Frank J. Uxa; Linda A. Fox

(57) ABSTRACT

An apparatus and system for removing debris and contaminants from water passing through a storm drain generally includes a debris trap adapted to fit within a storm drain a porous, filtering element adapted to separate debris from a water flow passing through the storm drain and a frame for directing the water flow into the porous element. The debris trap includes a frame element adapted to substantially prevent bypass of the debris trap, especially during low water flow conditions. The system may further include a debris block adapted to prevent debris from entering a back curb inlet opening of the storm drain. The debris block includes foam end members for adjustably securing and/or sealing the debris block to edges of the drain inlet.

21 Claims, 2 Drawing Sheets

1
18
16
3
12
73
72
20
42
40
42
14
3

16
20
26
32
1
50
63
58
14
66
12
54
62
65
15

70
84
86
88
102
96
96

DRAINAGE FILTER SYSTEM FOR DEBRIS AND CONTAMINANT REMOVAL

BACKGROUND OF THE INVENTION

The present invention generally relates to systems and methods for treating water and more specifically relates to systems and methods for separating debris and contaminants from water passing into drains, for example storm drains adjacent paved surfaces, such as along streets in municipalities, parking areas and other similar locations.

Drainage systems collect and direct rainwater and runoff to underground storm sewers to prevent flooding of streets. In some geographic regions, this untreated water is drained directly into the ocean not far from public beaches. Until relatively recently, it was not well appreciated that even residential runoff water can be highly contaminated, and may pose serious threats to the environment and public health.

Typical storm drainage systems include drain inlets placed at margins of streets and roadways and adjacent sidewalks. The drain inlet is commonly equipped with a removable iron grate element that covers at least a portion of the inlet. In addition to providing a safety means, for example to prevent small children and animals from falling into the drain opening, the grate element is designed to prevent some of the relatively larger debris and trash items, such as tree branches, large paper or plastic containers, from entering the storm drain inlet. However, substantial volumes of relatively smaller trash items and debris, including lawn clippings, leaves, empty beverage containers, paper and plastic wrappers and the like, regularly pass into storm drains despite the use of iron grates. These items will eventually cause clogging of the drainage system if not periodically removed. In addition, such iron grates have been found to be ineffective in preventing gradual accumulation of solid materials that enter the drain inlet through open spaces between edges of the drain inlet and a perimeter of the grate element.

Assemblies have been developed for filtering a water flow entering drain system inlets. For example, it is known to place a screen or other porous element below the grate element to collect smaller trash and debris. However, such systems are prone to becoming clogged with debris, thereby obstructing water flow into the storm drain. In addition, such assemblies have not been designed for screening relatively low water flows into the drain inlet. A particularly slow water flow will often bypass the assembly entirely by seeping through unfiltered areas between edges of the assembly and the drain inlet.

Moreover, such periods of low water flow, especially following a relatively long "dry spell" tend to bring highly contaminated runoff water into the drains. This is due to long term accumulation of oils, automobile fluids, dust, dirt, lawn pesticides and other contaminants in the gutter areas of residential and industrial streets.

Devices have been proposed to address the problem of polluted runoff water in drainage systems. For example, U.S. Pat. No. 6,106,707 to Morris et al., which is incorporated herein in its entirety by this specific reference, discloses a modular insert for curb-inlet storm drains for collecting both trash and oil and other hydrocarbons. The device generally comprises a perforated hopper that fits inside a storm drain inlet. The hopper contains fragments of oil absorbent material for entrapping oil in runoff water flowing through the hopper. Although addressing some of the problems associated with present drainage systems, the Morris et al. device and similar conventional devices may be inconvenient and expensive to maintain and do not address other problems that are solved by the present invention.

SUMMARY OF THE INVENTION

New drainage filter apparatus and systems for debris and contaminant removal have been discovered. Such apparatus and systems are straightforward in construction and highly effective in removing particulate matter, debris and contaminants, such as hydrocarbons and other harmful substances from water flowing through a storm drain. The present systems are also easy and inexpensive to maintain and do not hinder or obstruct water flow into drainage systems.

Generally, the present invention is directed to an apparatus for removing debris and contaminants from water passing through a storm drain, for example a storm drain along a city street. The present apparatus typically comprises a debris trap adapted to fit within the storm drain, wherein the debris trap includes a porous element adapted to separate debris from a water flow passing through the storm drain. The apparatus further comprises a frame having a peripheral portion adapted to direct the water flow into the porous element of the debris trap and to prevent bypass of the debris trap during low water flow conditions.

Preferably, the peripheral portion of the frame is sized and shaped to substantially overlap an edge of an inlet opening of the storm drain. In a specific embodiment of the invention, the peripheral portion of the frame comprises an angled iron frame element.

Advantageously, the porous element comprises a sieve element that is removably connected to the frame to facilitate periodic removal and cleaning and/or replacement thereof. The porous element preferably further comprises at least one handle member adapted to facilitate the manual removal of the sieve element from the frame.

The apparatus preferably further comprises a body portion depending from the frame and extending beneath the porous sieve element. The body portion is made of a substantially non-water permeable material, for example a nylon or other polymeric material, and importantly includes an outlet for allowing the water flow to pass into the drain outlet into the sewer system. Furthermore, the body portion and outlet are advantageously structured so that substantially all water passing into the body portion is passed through the outlet before being discharged from the storm drain. A filter member, for example a filtering screen, may be secured across the body portion outlet.

Preferably, the apparatus further comprises a contaminant containment element secured, preferably removably secured, across the body portion outlet. The contaminant containment element comprises a contaminant removal material effective to remove one or more selected contaminants from the water flow as the water flow passes through the contaminant containment element and finally into the storm drain outlet. For example, the contaminant removal material may comprise a material that physically or chemically interacts with contaminants in water, for example dissolved in water, to prevent such contaminants from passing the contaminant containment element and into the sewer system. In one embodiment, the contaminant removal material comprises an oil absorbent material such as polypropylene, though other materials may also be useful depending upon the selected contaminants to be removed, for example, materials which are effective to remove components, microbes, soluble waste products, other water soluble contaminants and the like may be included in the contaminant containment element. Many such materials are known and commercially available. The filtering screen is preferably secured across the body portion outlet downstream of the contaminant containment element.

In one particularly advantageous embodiment of the invention, the porous sieve element comprises a material having a flow rate capacity of at least about 145 gallons per minute per square foot. For example, the material may be a material having a 40 Sieve (U.S. Sieve) porosity. It is further noted that the filtering screen secured across the outlet may comprise the same or similar material.

The present invention is designed to facilitate removal and replacement of the contaminant containment element. After a period of use, the containment element may require replacement in order to assure quality of filtering thereby. For example, the contaminant containment element may be contained by a flexible pocket element defined by the body portion. More specifically, the pocket element is located at least partially about the body portion outlet, preferably substantially surrounding the body portion outlet. The pocket element is structured to at least assist in securing the contaminant containment element across the body portion outlet. The pocket is designed to prevent the contaminant containment element from shifting or otherwise becoming displaced from its desired position across the outlet. In one embodiment, the contaminant containment element is a "pillow" form, which further facilitates removal as needed. The contaminant removal material may be encased in a porous mesh or woven material for example in the form of a pillow or other conveniently removable configuration.

One aspect of the present invention is directed to a system for removing debris from water passing into a storm drain having both a back curb inlet opening and a gutter inlet opening. More specifically, the system of this aspect of the present invention comprises the debris trap assembly described elsewhere herein, and in addition a debris block assembly that is structured and sized to be positioned across the back curb inlet opening.

Particularly, the debris block assembly is designed to direct water and debris into the gutter inlet opening to prevent bypass of the present debris trap. The debris block assembly preferably comprises an outer sleeve, an inner sleeve disposed within the outer sleeve, and means, for example one or more sealing members, for sealing or securing the debris block assembly against edges of the back curb inlet opening of the storm drain. The means for sealing or securing may include for example, flexible foam end members disposed in opposing ends of the inner sleeve. The outer sleeve preferably comprises a textile material or other suitable material, such as a geotextile material, to be described in greater detail hereinafter. The inner sleeve preferably comprises a polymeric, e.g. PVC or the like, pipe or member which is substantially rigid and is effective for providing rigidity to the assembly. A relatively heavy metal, e.g. iron, steel or the like, bar having a length longer than the length of the inlet opening may also be provided to secure the debris block assembly in place.

Each individual feature and each combination of two or more features described herein are included within the scope of the present invention provided that the features included in the combination are not mutually inconsistent.

These and other aspects and advantages of the present invention are set forth in the following detailed description and claims, particularly when considered in conjunction with the accompanying drawings in which like parts bear like reference numerals.

DETAILED DESCRIPTION OF THE DRAWINGS

Figure 1:
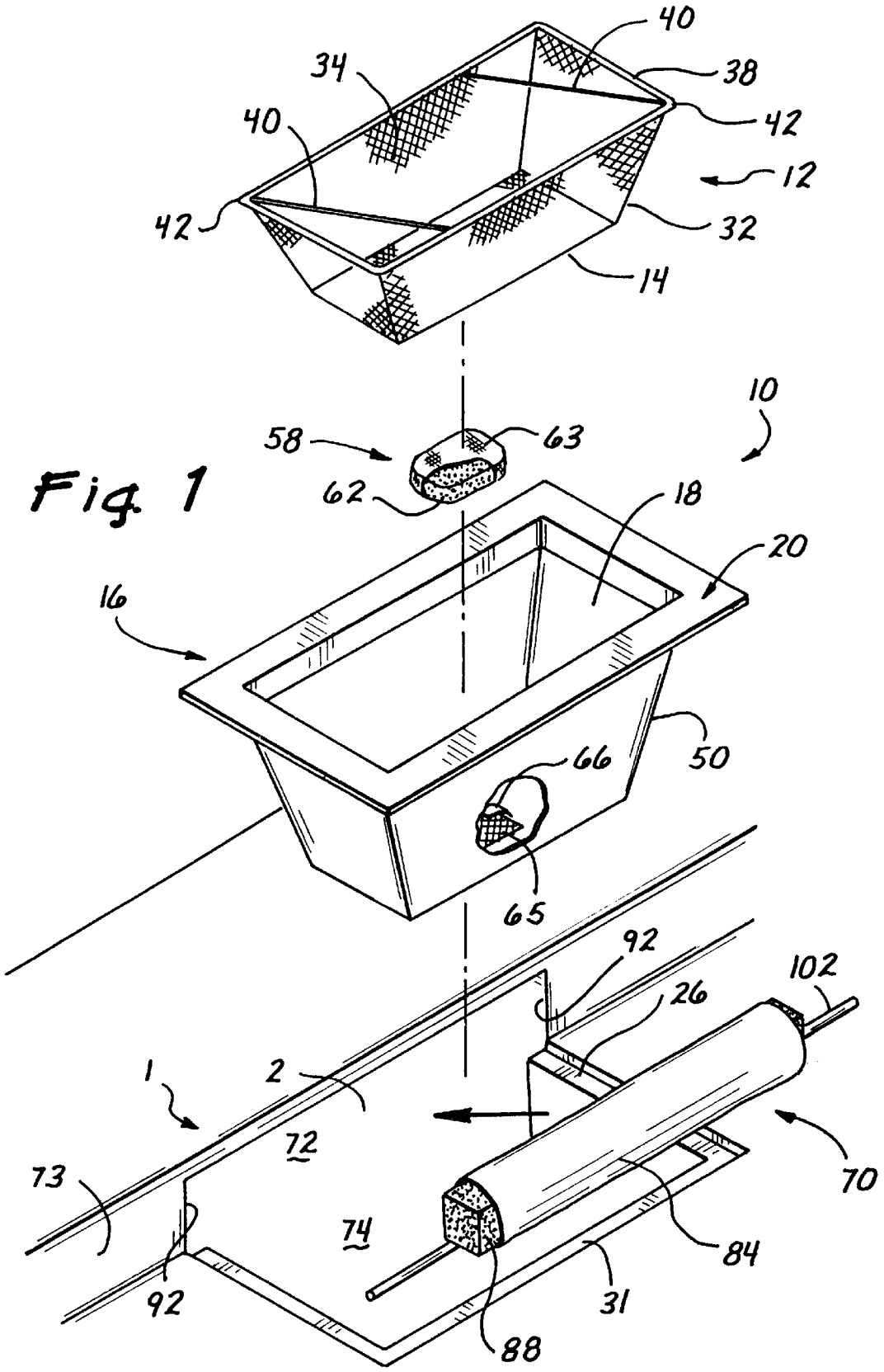
FIG. 1 is an exploded view, partly in cross section, of an embodiment of a drainage filter system in accordance with the present invention, including a debris trap, a contaminant containment element and a debris block, for use on a typical storm drain.

With reference to FIG. 1, an apparatus for removing debris from water passing through a storm drain 1 by means of a storm drain inlet opening 2, is shown generally at 10. The present apparatus 10 generally comprises a debris trap 12 sized and adapted to fit within the storm drain 1, and including a porous element 14 adapted to separate debris from a water flow passing through the storm drain 1 into a storm drain outlet 15 (see FIG. 3). The apparatus 10 further comprises a frame 16 defining an inlet 18 and having a peripheral portion 20 adapted to direct the water flow into the porous element 14.

Figure 2:
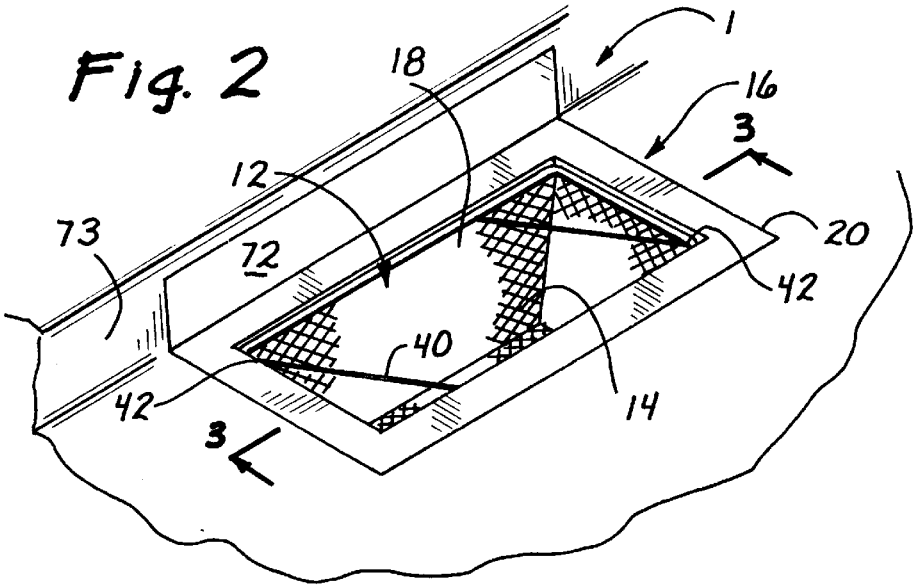
FIG. 2 is a top view of the system shown in FIG. 1 as installed in the storm drain.

Importantly, the frame 16 is further adapted and to prevent bypass of the debris trap 12, particularly during low water flow conditions. For example, turning as well now to FIG. 2 and FIG. 3, the peripheral portion 20 of the frame 16 is sized and shaped to substantially overlap an edge 26 of the inlet opening 2 of the storm drain 1. For example, in the embodiment 10 shown, the peripheral portion 20 of the frame 16 comprises an angled iron frame element 30, as shown most clearly in FIG. 3. Although the frame 16 is shown as being set within a recessed perimeter 31 of the drain inlet 2, the frame may more substantially overlay the drain inlet edge.

Although not shown for the sake of clarity, a storm drain, such as the shown storm drain 1, is typically equipped with a metal grate element for blocking larger trash items from entering the drain inlet 2. When the present invention 10 is installed in conjunction with such a grate element, the frame 16 extends beyond the perimeter of the grate element and directs the flow of water into the debris trap 12. During low water flow conditions, water and debris often enters the drain inlet 2 through open areas between the grate element and the drain inlet edge, thereby bypassing any conventional filter or screening device that may be installed. Advantageously, the frame 16 of the present invention is structured to substantially prevent water bypass of such grate element or screening device by directing substantially all of the water flow into the frame inlet 18.

Moreover, the frame 16 functions to prevent bypass of the porous element 14 feature of the present invention 10. The porous element 14 comprises a sieve element 32, hereinafter sometimes referred to simply as a "sieve" for the sake of clarity. The sieve 32 functions to separate solid debris and trash items from water entering the drain 1. Preferably, the sieve 32 is made of a material having a flow rate capacity of at least about 145 gallons per minute per square foot, for example a material with a 40 Sieve porosity. For example, the material may be a monofilament polypropylene material under the trade name Mirafi FilterWeave 401 available from T. C. Mirafi.

The porous element 14 includes a perimeter portion 38 which defines an opening 34 that is sized to substantially conform to the frame inlet 18. The porous element 14 is removably connected to the frame 16 at the sieve perimeter portion 38, and further comprises at least one handle member 40, with two handle members 40 in the shown embodiment 10. The handle members 40 are adapted to facilitate manual removal of the sieve element 32 from the frame 16. The handle members 40 may be permanently welded to the sieve perimeter portion 38. As shown, the handle members 40 are disposed in an angular fashion from opposing corners 42 of the perimeter portion 38. The shown structure is designed to provide sufficient strength to the porous element 12 upon the porous element 12 being lifted from the drain 1. The structure prevents the porous element from becoming substantially deformed upon the manual lifting thereof, particularly when the sieve 32 may be heavy with debris.

Figure 3:
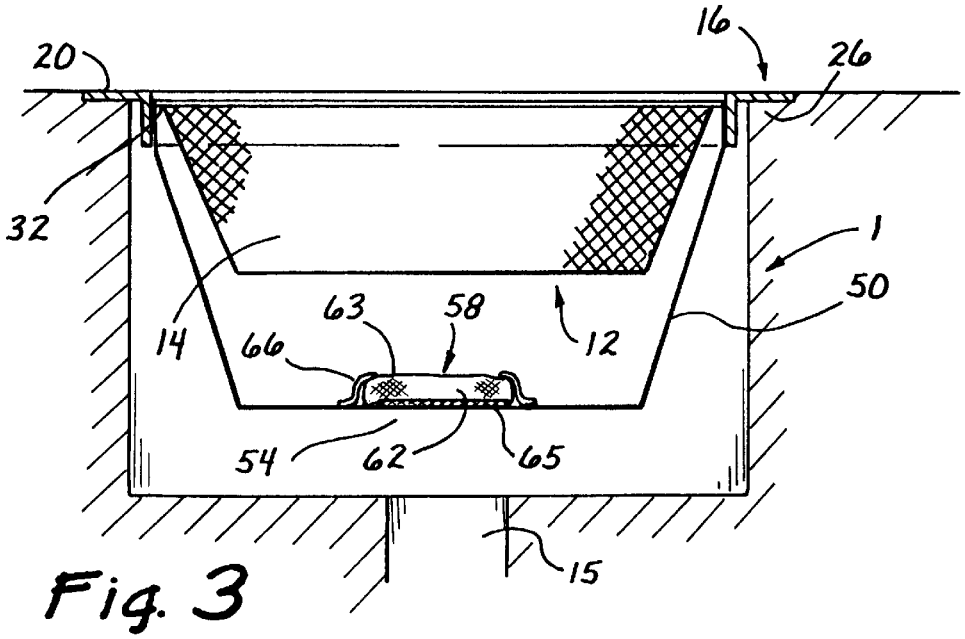
FIG. 3 shows a cross sectional view of the system taken across line 3—3 of FIG. 2.

Referring now to FIGS. 1 and 3, the apparatus 10 further comprises a body portion 50, comprising a substantially water impermeable material such as nylon or other polymeric material, depending from the frame 16 and having an outlet 54. The body portion 50 and the outlet 54 are structured so that substantially all water passing into the body portion 50 is passed through the outlet 54 before being discharged from the storm drain 1.

In one particularly advantageous aspect of the invention, a contaminant containment element 58 is removably secured across the body portion outlet 54 to provide a means for removing contaminants from the water flow passing through the apparatus 10. The contaminant containment element 58 includes a suitable material 62 effective to remove one or more selected contaminants from the water flow as the water flow passes through the contaminant containment element 58. The contaminant containment element 58 further comprises a water permeable mesh enclosure 63, encasing the contaminant removal material 62. For example, the mesh enclosure 63 may comprise a monofilament polypropylene material having a flow rate of at least about 145 gallons per minute per foot.

The contaminant removal material 62 may comprise polypropylene, more specifically a meltblown polypropylene absorbent or other suitable materials that can absorb and entrap oils, and crude or refined hydrocarbon products, including crude oil of any viscosity and gasoline or other refined fuels. For example, in a specific embodiment of the invention, the contaminant removal material comprises about 1.9 pounds of meltblown polypropylene material manufactured by Ergon Environment Products, Inc. This material will contain up to 5.5 gallons of high viscosity heavy crude oil, 3.0 gallons of medium viscosity diesel fuel, or 2.7 gallons of low viscosity gasoline.

Other embodiments of the invention may provide contaminant removal materials effective in removing or chemically reacting with such harmful chemical pollutants, such as benzene, carbon disulfide and various chlorinated hydrocarbons substances. It is also anticipated that the material 62 may comprise a bactericide suitable for destroying harmful microbes and organisms in the water flow.

Preferably a filter element or screen 65 is disposed across the body portion outlet 54. In addition, the body portion 50 may define means for removably securing the contaminant containment element 58 across the outlet 54. For example, the contaminant containment element 58 is contained by a flexible pocket element 66 defined by the body portion 50. More specifically, the pocket element 66 is located at least partially about the body portion outlet 54, preferably substantially surrounding the body portion outlet 54. The pocket element 66 is structured to at least assist in securing the contaminant containment element across the body portion outlet. The pocket member 66 is designed to prevent the contaminant containment element 58 from shifting or otherwise becoming displaced from its desired position across the outlet 54, yet allows for easy removal and replacement of the contaminant containment element 66 as necessary.

Figure 4:
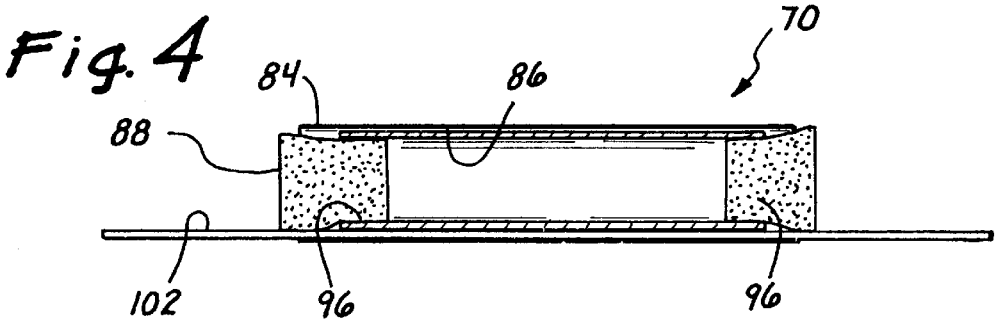
FIG. 4 shows a cross sectional view of the debris block element of the system shown in FIG. 1.

Referring now specifically to FIGS. 1 and 4, another aspect of the present invention, is shown. More specifically, the present invention 10 may comprise a system for removing debris from water passing into the storm drain 1, wherein the system comprises a debris block assembly 70.

For purposes of the this application, the storm drain inlet 2 may more specifically be described as including both a back curb inlet opening 72 defined in a curb 73 for example, and a gutter inlet opening 74. This type of storm drain inlet 2 is typical, for example, along residential and city sidewalks and roadways in areas of Northern California. The debris block assembly 70 is structured and sized to be positioned across a lower portion of the back curb inlet opening 72, leaving an open area above the debris block assembly 70.

The debris block assembly 70 is designed to direct water and debris into the gutter inlet opening 72 to prevent bypass of the debris trap 12. Turning now specifically to FIG. 4, the debris block assembly 70 preferably comprises an outer sleeve 84, an inner sleeve 86 disposed within the outer sleeve 84, and means, for example one or more sealing members 88, for sealing or securing the debris block assembly 70 against edges 92 (see FIG. 1) of the back curb inlet opening 72 of the storm drain 1. The debris block assembly 70 is positioned to obstruct entry of debris through the back curb inlet opening 72 of the storm drain 1.

Preferably, the means for sealing or securing include for example, flexible foam end members 88 disposed in opposing ends 96 of the inner sleeve 86. The foam end members 88 may more specifically comprise, for example 5" square industrial grade foam or other suitable commercially available flexible compressible material. Notably, the foam end members 88 allow for some length adjustment of the debris block assembly 70 as the members 88 can be adjustably positioned within the inner sleeve 86. The debris block assembly 70 is secured sufficiently to prevent the assembly from becoming dislodged in the event of a storm surge or at other high flow times. Naturally, during times of high flow, water travels over the debris block assembly and into the upper, uncovered portion of the back curb inlet opening 72.

The outer sleeve 84 preferably comprises a flexible material, preferably a geotextile material. More specifically, the outer sleeve preferably comprises a woven or nonwoven, durable geotextile drainage fabric. Many such materials are commercially available. The geotextile outer sleeve allows water to filter through the outer sleeve material while trapping soils and sediments behind the drain block assembly 70.

The inner sleeve 86 preferably comprises a polymeric, for example polyvinyl chloride (PVC), pipe or the like, or other member which is substantially rigid in order to provide sufficient rigidity to the assembly. The inner sleeve functions in part to block larger trash items and debris from entering the drain inlet 2 through the back curb inlet opening 72.

Means for bracing the assembly 70 against the curb 73 to stabilize the block assembly 70 across the back curb inlet opening 72 is preferably provided. For example, a support bar member 102, for example comprising a relatively heavy metal, e.g. iron, steel or the like, having a length longer than the length of the inner sleeve 86, and having a length longer than the length of the inlet opening 72 is disposed through the assembly 70, for example through the inner sleeve 86. The bar member 102 may specifically comprise ⅜" rebar of a sufficient length.

During high flow times, the flow rate through the storm drain 1 will be moving fast enough that much of the water will flow over the debris block assembly 70 and into the back curb opening inlet portion left uncovered and may at times bypass the debris trap 12 as well. This is desirable however, because such bypass reduces any chance of damage to the assemblies of the present invention that could result from the powerful force of the water flow. On the other hand, during times of low water flow, the present invention 10 effectively prevents bypass of the debris trap 12, thereby directing substantially all water into the debris trap 12 and through the contaminant containment element 58 prior to being discharged through the drain outlet 15.

While the invention has been described with respect to various specific examples and embodiments, it is to be understood that the invention is not limited thereto and that it can be variously practiced within the scope of the following claims.

What is claimed is:

1. An apparatus for removing debris from water passing through a storm drain, the apparatus comprising:

a debris trap adapted to fit within a storm drain, and including a porous element adapted to separate debris from a water flow passing through the storm drain; and a frame defining an inlet and having a peripheral portion adapted to direct the water flow into the porous element and to prevent bypass of the debris trap during low water flow conditions;

a contaminant containment element; and a body portion depending from the frame and having an outlet and defining a pocket element substantially surrounding the outlet, the pocket element being effectively structured to at least assist in securing the contaminant containment element across the body portion outlet and to facilitate removal and replacement of the contaminant containment element, the body portion and the outlet being structured so that substantially all water passing into the body portion is passed through the outlet before being discharged from the storm drain.

2. The apparatus of claim 1 wherein the peripheral portion of the frame is sized and shaped to substantially overlap an edge of an inlet opening of the storm drain.

3. The apparatus of claim 1 wherein the peripheral portion of the frame comprises an angled frame element sized and shaped to substantially overlap an edge of an inlet opening of the storm drain.

4. The apparatus of claim 1 wherein the porous element comprises a sieve element removably connected to the frame.

5. The apparatus of claim 4 wherein the porous element further comprises at least one handle member adapted to facilitate manual removal of the sieve element from the frame.

6. The apparatus of claim 1 further comprising a filtering screen secured across the body portion outlet, and the filtering screen comprises a material having a flow rate capacity of at least about 145 gallons per minute per square foot, and has a 40 Sieve (U.S.) porosity.

7. The apparatus of claim 1 wherein the contaminant containment element comprises a contaminant removal material effective to remove one or more selected contaminants from the water flow as the water flow passes through the contaminant containment element.

8. The apparatus of claim 7 wherein the contaminant containment element further comprises a water permeable mesh enclosure encasing the contaminant removal material.

9. The apparatus of claim 7 wherein the contaminant removal material comprises an oil absorbing material.

10. The apparatus of claim 1 wherein the frame includes two spaced apart handle members extending across the frame inlet.

11. The apparatus of claim 10 wherein the frame includes at least one side defining the inlet and the two handle members extend obliquely with respect to the at least one side of the frame.

12. The apparatus of claim 10 wherein the at least one side comprises at least four sides and the two handle members are substantially parallel with respect to each other.

13. An apparatus for removing debris and contaminants from water passing through a storm drain, the apparatus comprising:

a body-portion including an inlet adapted to receive a flow of water passing into a storm drain and an outlet for allowing the water flow to pass into an outlet opening of the storm drain; and a contaminant containment element removably secured to the body portion and positioned across the body portion outlet;

the body portion defining a pocket element substantially surrounding the body portion outlet, the pocket element being effectively structured to at least assist in securing the contaminant containment element across the body portion outlet and to facilitate removal and replacement of the contaminant containment element.

14. The apparatus of claim 13 which further comprises a debris trap, adapted to fit within the body portion.

15. The apparatus of claim 13 wherein the body portion comprises a substantially water impermeable material.

16. The apparatus of claim 13 wherein the contaminant containment element comprises a contaminant removal material effective to remove one or more selected contaminants from the water flow as the water flow passes through the contaminant containment element.

17. The apparatus of claim 16 wherein the contaminant removal material comprises an oil absorbing material.

18. The apparatus of claim 13 further comprising a frame, at least partially surrounding the body portion inlet, and including a peripheral portion adapted to direct the water flow into the body portion and to prevent bypass of the body portion during low water flow conditions.

19. The apparatus of claim 13 wherein the frame includes two spaced apart handle members extending across the frame inlet.

20. The apparatus of claim 19 wherein the frame includes at least one side defining the inlet and the two handle members extend obliquely with respect to the at least one side of the frame.

21. The apparatus of claim 19 wherein the at least one side comprises at least four sides and the two handle members are substantially parallel with respect to each other.

* * * * *